US005351026A

United States Patent [19]

Kanbara et al.

[11] Patent Number: 5,351,026

[45] Date of Patent: Sep. 27, 1994

[54] THERMISTOR AS ELECTRONIC PART

[75] Inventors: Shigeru Kanbara, Kyoto; Hitoshi Fukui, Takasago, both of Japan

[73] Assignee: Rohm Co., Ltd., Kyoto, Japan

[21] Appl. No.: 19,309

[22] Filed: Feb. 18, 1993

[30] Foreign Application Priority Data

Feb. 25, 1992 [JP] Japan ..... 4-037879

[51] Int. Cl.[5] ..... H01C 7/10; H01C 1/14

[52] U.S. Cl. ..... 338/22 R; 338/22 SD; 338/322

[58] Field of Search ..... 338/22 R, 225 D, 322

[56] References Cited

U.S. PATENT DOCUMENTS 5,142,267 8/1992 Fellner et al. ..... 338/22 R 5,210,517 5/1993 Abe ..... 338/22 R

*Primary Examiner*—Marvin M. Lateef

*Attorney, Agent, or Firm*—Dickstein, Shapiro & Morin

[57] ABSTRACT

A thermistor includes a rectangular parallelepiped thermistor element, electrodes formed over the entire top and bottom surfaces of the thermistor element, and leads connected to the electrodes. The leads have connecting portions for deriving signals, and are bent such that the connecting portions are positioned on substantially the same plane. A sealing resin completely surrounds the thermistor element, the electrodes, and all of the leads except for the connecting portions.

5 Claims, 3 Drawing Sheets

THERMISTOR AS ELECTRONIC PART

BACKGROUND OF THE INVENTION

1. Field of the Invention

The present invention relates to a thermistor as an electronic part.

2. Description of the Related Art

A negative temperature coefficient thermistor (hereinunder referred to as "NTC") in which the resistance lowers with the rise of a temperature, a positive temperature coefficient thermistor (hereinunder referred to as "PTC") in which the resistance increases with the rise of a temperature, and a critical temperature thermistor are known. The temperature of the apparatus on which such a thermistor is mounted is detected by measuring the electrical resistance of the thermistor.

The NTC, which is generally composed of Mn, Co, Ni and Cu, is easily affected by an oxidizing atmosphere, while the PTC, which is generally composed of $BaTiO_3$, is easily affected by a reducing atmosphere. Therefore, these thermistors are coated with glass except for the portions at which electrodes are formed, before they are mounted on a substrate. FIG. 1 shows such a thermistor mounted on a substrate. As shown in FIG. 1, the surface of a thermistor element 11 is coated with glass. Both side surfaces of the thermistor element 11 are not coated with glass because electrodes are formed thereon. A silver paste is pasted to the side surfaces of the thermistor element 11 which are not coated with glass so as to form electrodes 13. Connecting portions 17 for receiving bonding wires 15 are formed on the upper surface of the thermistor element 11. A thermistor 19 as an electronic part produced in this manner is mounted on a substrate 21 and bonded with the bonding wires 15.

This thermistor 19 is defective in that the resistance changes depending upon the size and the thickness of the electrodes 13. It is therefore necessary to paste the silver paste to a uniform thickness on thermistor elements in order to keep the resistance uniform in the thermistors produced. However, it is difficult to paste a silver paste to a uniform thickness because the thickness of the applied paste largely varies in accordance with the viscosity and the quantity of the silver paste. As a result, it is difficult to produce the thermistors 19 having a uniform resistance, so that the yield of the thermistors 19 is conventionally low.

In addition, since the glass coat and the electrodes 13 are directly provided on the thermistor element 11, the electrodes 13 are sometimes peeled off when the bonding wires 15 are soldered, which changes the resistance of the thermistor 19, or the thermistor 19 is sometimes broken by thermal shock at the time of soldering.

SUMMARY OF THE INVENTION

Accordingly, it is an object of the present invention to eliminate the above-described problems in the related art and to provide a thermistor as an electronic part which is capable of preventing the resistance from differing in thermistors due to the difference in thickness of the paste applied to form electrodes and, at the time of soldering, preventing the resistance from changing and the thermistor element from being broken due to thermal shock.

To achieve this aim, a thermistor as an electronic part according to the present invention is produced by forming electrodes on opposite surfaces of a plate-like thermistor element so that a current flows to the thermistor element, and enclosing the thermistor element with a resin except for the portions for receiving bonding wires.

According to this structure, if the surface area of the thermistor element is constant, the area of the portions at which the electrodes are connected to the thermistor element are also constant, so that it is possible to prevent the resistance from differing with the state in which the electrodes are connected to the thermistor element. In addition, since the thermistor element is not coated with glass but sealed with a resin, the thermistor withstands use both in an oxidizing atmosphere and in a reducing atmosphere. Since the thermistor element is not coated with glass before the formation of electrodes but is enclosed with a resin after the formation of electrodes, the shock resistance of the thermistor is improved. Furthermore, since the thermistors are soldered with bonding wires at portions which are apart from the portions at which the electrodes are connected to the thermistor element, it is possible to prevent the thermistor from being broken by the soldering heat. The electrodes are preferably formed on the upper and the lower surfaces of the thermistor element in such a manner as to sandwich the thermistor element therebetween in the vertical direction.

The above and other objects, features and advantages of the present invention will become clear from the following description of the preferred embodiment thereof, taken in conjunction with the accompanying single drawing.

DESCRIPTION OF THE PREFERRED EMBODIMENT

A preferred embodiment of a thermistor as an electronic part according to the present invention will now be explained with reference to the accompanying drawings.

Figure 1:
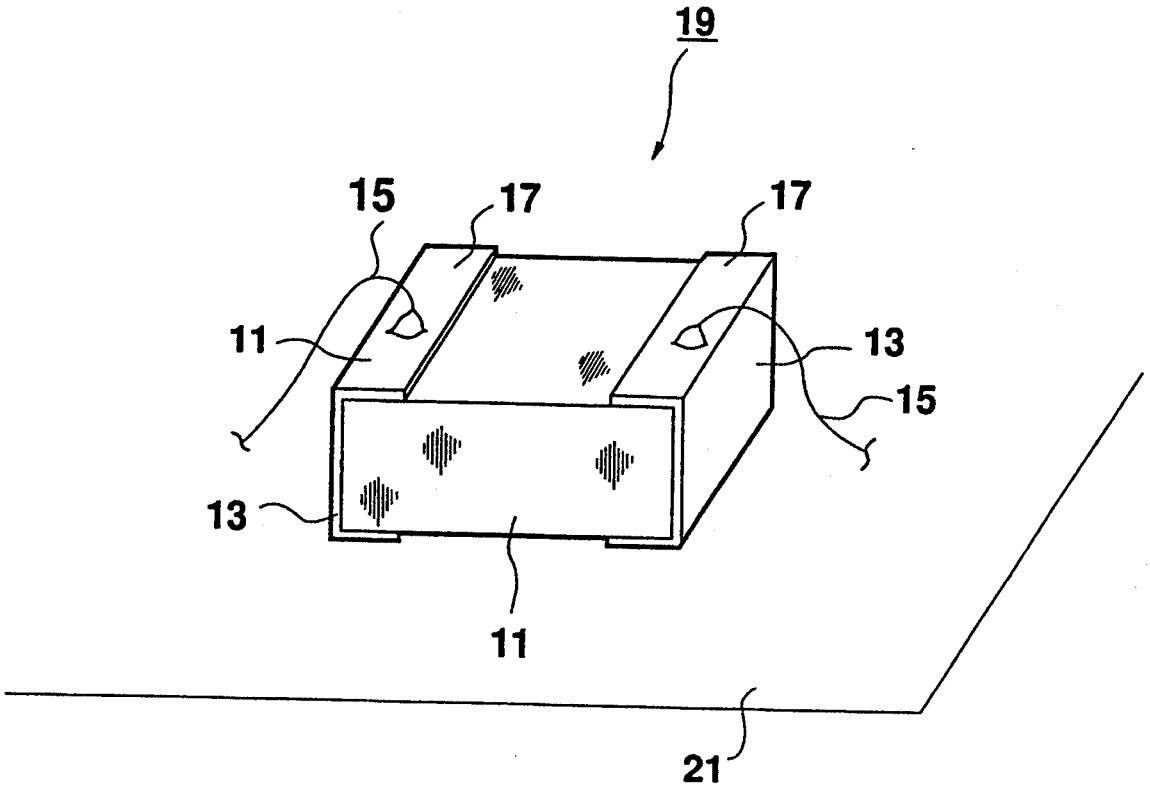
Fig. 1 PRIOR ART
FIG. 1 is a perspective external view of a general example of a conventional thermistor as an electronic part.
Figure 2:
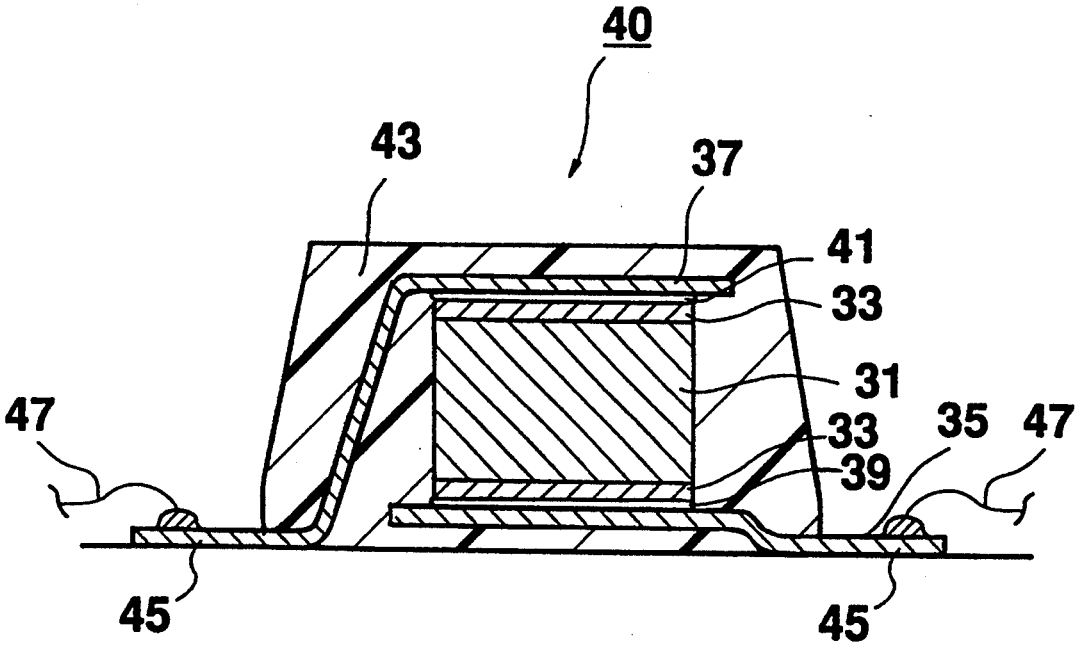
FIG. 2 is a sectional view of the main part of an embodiment of a thermistor as an electronic part according to the present invention.
Figure 3:
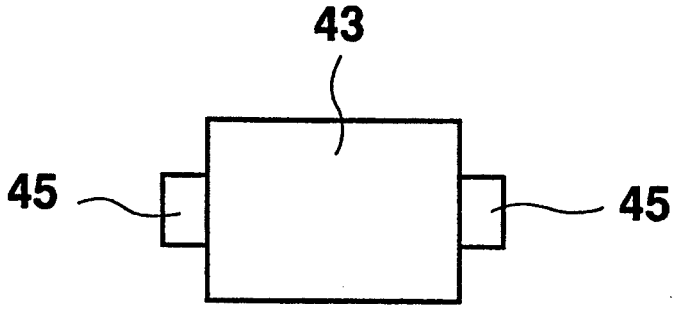
FIGS. 3(*a*) and 3(*b*) are plan view and a side elevational view, respectively, of the embodiment shown in FIG. 2.
Figure 3:
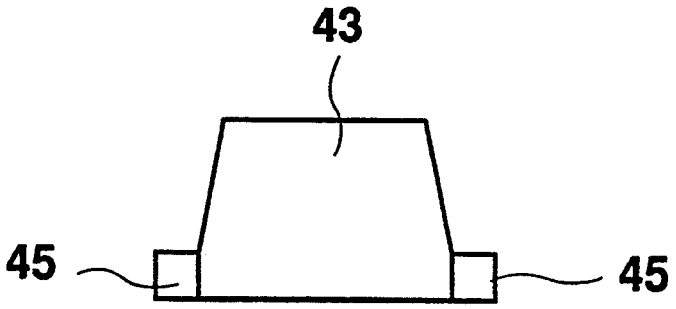

FIG. 2 is a sectional view of the main part of an embodiment of a thermistor as an electronic part according to the present invention, and FIGS. 3(*a*) and 3(*b*) are a plan view and a side elevational view thereof.

A thermistor 40 is composed of a rectangular parallelepiped thermistor element 31, electrodes 33 formed on the vertically opposite surfaces of the thermistor element 31, and an approximately linear lead 35 and a bent lead 37 which sandwich the thermistor element 31 therebetween. The electrode 33 and the lead 35, and the electrode 33 and the lead 37 are connected with each other by solder joints 39 and 41, respectively. The thermistor element 31 in this state is enclosed with a sealing resin 43 so as to make a package, thereby producing the thermistor 40. At this time, the connecting portions 45 of the leads 35 and 37 which are to be bonded are left outside of the sealing resin 43. Bonding wires 47 are bonded to the connecting portions 45. In this embodiment, the electrodes 33 are formed by sputtering a metal onto both surfaces of the thermistor element 31. As the sealing resin 43, an epoxy resin is used in view of the small shrinkage factor thereof. As shown in FIG. 2, the lead 35 is slightly bent so as to hold the thermistor element 31 in the state in which the thermistor element 31 is floating above a substrate. This is in order to prevent the thermistor element 31 from being separated from the lead 35 due to the heat produced by the solder reflow process adopted for the production of the thermistor 40. The thermistor 40 obtained by enclosing the thermistor element 31 with the electrodes 33 and the leads 35, 37 attached thereto in this manner, and by enclosing the whole with the sealing resin 43 is highly resistant to heat and shock.

The thermistor element 31 is an ordinary plate-like element composed of a ceramic material or the like with electrodes 33 formed thereon. The leads 35, 37 as lead frames are extended from the thermistor element 31 in the horizontal direction. The connecting portions 45 protrude from the sealing resin 43, as shown in FIGS. 3(*a*) and 3(*b*). That is, the exposed portions of the leads 35, 37 which are not sealed with the resin 43 form the connecting portions 45. The connecting portions 45 are formed in the same plane and protrude from approximately the centers of both sides of the bottom surface of the thermistor 40, as shown in FIG. 3(*a*). Thus, the connecting portions 45 are easy to solder at the time of mounting the thermistor 40 on a substrate. The thermistor 40 in this embodiment is a general purpose two-terminal molded thermistor, and it is possible to automatically hold the thermistor 40 by a conventional chip mounter and mount it on a substrate.

The thermistor of the present invention having the above-described structure produces the following advantages:

(1) There is no difference in resistance among thermistors due to the difference in thickness of the paste applied to form the electrodes.

(2) Since the leads are utilized as external terminals, the electrodes of the thermistor element is free from the excessive force which otherwise might be applied thereto at the time of soldering, so that the resistance does not vary.

(3) Since the thermistor is completely sealed with the resin, the heat produced by soldering is not directly conveyed to the thermistor element. The thermistor element is therefore not broken due to thermal shock. In addition, the thermistor has excellent moisture resistance.

(4) Since the thermistor has an ordinary plate-like thermistor element which is very small in size, the time constant is smaller than that of a conventional thermistor as an electronic element.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A thermistor as an electronic part comprising:

a rectangular parallelepiped thermistor element, said thermistor element having a top surface and a bottom surface;

a first electrode formed over the entirety of said top surface of said thermistor element, and a second electrode formed over the entirety of said bottom surface of said thermistor element;

a first lead connected to said first electrode, said first lead including a contacting portion in contact with said first electrode and a connecting portion for deriving signals, and a second lead connected to said second electrode, said second lead including a contacting portion in contact with said second electrode and a connecting portion for deriving signals, said first and second leads being bent such that said connecting portion of said first lead and said connecting portion of said second lead are positioned on substantially the same plane, thereby allowing said thermistor to be mounted on a substrate; and a sealing resin completely surrounding said thermistor element, said first and second electrodes, and all of said first and second leads except for said connecting portions.

2. A thermistor as defined in claim 1, wherein said thermistor element is supported separately apart from the substrate by said first and second leads.

3. A thermistor as defined in claim 1, wherein said connecting portions and a bottom surface of said sealing resin are substantially in the same plane.

4. A thermistor as defined in claim 3, wherein said connecting portions of said leads are substantially parallel to said top and bottom surfaces of said thermistor element.

5. A thermistor as defined in claim 4, further comprising bonding wires connected to said connecting portions of said first and second leads.

* * * * *